United States Patent [19]

Sawyer et al.

[11] Patent Number: 5,033,560

[45] Date of Patent: Jul. 23, 1991

[54] DRILL BIT WITH DECREASING DIAMETER CUTTERS

[75] Inventors: George S. Sawyer, Mathis; William W. King, Spring, both of Tex.

[73] Assignee: Dresser Industries, Inc., Dallas, Tex.

[21] Appl. No.: 557,627

[22] Filed: Jul. 24, 1990

[51] Int. Cl.[5] ..... E21B 10/36

[52] U.S. Cl. ..... 175/410; 175/415; 175/417

[58] Field of Search ..... 175/415, 417, 410, 329, 175/409

[56] References Cited

U.S. PATENT DOCUMENTS

| | | | |
|---|---|---|---|
| 4,073,354 | 2/1978 | Rowley et al. | 175/410 |
| 4,156,329 | 5/1979 | Daniels et al. | 175/329 |
| 4,186,628 | 2/1980 | Bonnice | 76/108 A |
| 4,221,270 | 9/1980 | Verzirian | 175/410 |
| 4,244,432 | 1/1981 | Rowley et al. | 175/410 |
| 4,246,977 | 1/1981 | Allen | 175/410 |
| 4,253,533 | 3/1981 | Baker, III | 175/410 |
| 4,265,324 | 5/1981 | Morris et al. | 175/410 |
| 4,303,136 | 12/1981 | Ball | 175/410 |
| 4,323,130 | 4/1982 | Dennis | 175/410 |
| 4,334,585 | 6/1982 | Upton | 175/410 |
| 4,350,215 | 9/1982 | Radtke | 175/410 |
| 4,465,148 | 8/1984 | Morris et al. | 175/410 |
| 4,499,958 | 2/1985 | Radtke et al. | 175/410 |
| 4,505,342 | 3/1985 | Barr et al. | 175/410 |
| 4,538,690 | 9/1985 | Short, Jr. | 175/410 |
| 4,538,691 | 9/1985 | Dennis | 175/393 |
| 4,558,753 | 12/1985 | Barr | 175/410 |
| 4,574,895 | 3/1986 | Dolezal et al. | 175/409 |
| 4,593,777 | 6/1986 | Barr | 175/410 |
| 4,596,296 | 6/1986 | Matthias | 175/379 |
| 4,602,691 | 7/1986 | Weaver | 175/410 |
| 4,667,756 | 5/1987 | King et al. . | |
| 4,682,663 | 7/1987 | Daly et al. | 175/410 |
| 4,686,080 | 8/1987 | Hara et al. | 175/329 |
| 4,696,354 | 9/1987 | King et al. | 175/329 |
| 4,699,227 | 10/1987 | Wardley | 175/410 |
| 4,700,790 | 10/1987 | Shirley | 175/410 |
| 4,705,122 | 11/1987 | Wardley et al. | 175/410 |
| 4,711,144 | 12/1987 | Barr et al. | 175/410 |
| 4,714,120 | 12/1987 | King | 175/329 |
| 4,723,612 | 2/1988 | Hicks | 175/410 |
| 4,733,734 | 3/1988 | Bardin et al. | 175/65 |
| 4,733,735 | 3/1988 | Barr et al. | 175/393 |
| 4,753,305 | 6/1988 | Fisher | 175/410 |

FOREIGN PATENT DOCUMENTS

| | | |
|---|---|---|
| 0032791 | 7/1981 | European Pat. Off. . |
| 2085945 | 5/1982 | United Kingdom . |

OTHER PUBLICATIONS

Mauer, W. C., Advanced Drilling Techniques; The Petroleum Publishing Co., Tulsa, Chap. 22; pp. 541–591 (1980).

*Primary Examiner*—Ramon S. Britts
*Assistant Examiner*—Roger J. Schoeppel
*Attorney, Agent, or Firm*—Johnson & Gibbs

[57] ABSTRACT

An earth boring bit having a body provided with a shank having a tubular bore and a head along the opposite end of said body having flow passages communicating with the bore, the head having face portions including a center end face portion, a nose portion, a shoulder portion, and a gage portion along the maximum diameter of the bit, and cutting elements mounted over said face portions having cutting faces oriented in the direction of rotation of the drill bit, the areas of the cutting faces of the cutting elements ranging from a maximum at the center face portion to a minimum at the gage portion of the bit. The cutters may be individually mounted, mounted in groups, arranged in random patterns, and arranged in a variety of other patterns, including radial longitudinal rows circumferentially spaced around the bit face.

11 Claims, 2 Drawing Sheets

DRILL BIT WITH DECREASING DIAMETER CUTTERS

BACKGROUND OF THE INVENTION

1. Field of the Invention

This invention relates to drag type rotary drill bits especially adapted for use in drilling oil and gas wells in earth formations, and, more particularly, this invention relates to drag type rotary drill bits using individual cutters arranged over the face of the bits including bits known as polycrystalline diamond compact bits, referred to herein as "PDC drill bits".

2. Description of the Prior Art

Drag type rotary drill bits have been known, particularly in the oil and gas industry, for a substantial number of years. They are connected on the lower end of an assembly of pipe sections secured in end to end array and known as "drill string". The drill string is rotated to turn the bit while advancing the bit downwardly to disintegrate or gouge out portions of an earth formation as the cutters are forced into the formation in a downwardly spiraling pattern. As is also well known, such bits have included flow channels for directing drilling fluids from the drill string outwardly through the bit around the cutters for keeping the bit cool, flushing cuttings from around the bit upwardly in the annulus around the drill string, and for imposing a hydrostatic head on the formation being drilled to retain formation fluids in the formation as a well is drilled. In recent years, cutting elements used in drag type rotary bits have been formed of super hard materials, such as tungsten carbide, and also of especially effective and more commonly used materials known as "thermally stable polycrystalline diamond material". The artificial diamond material may be used individually or as a component of a composite compact or insert on a cemented tungsten carbide substrate. Recently, a new artificial polycrystalline diamond has been developed which is stable at higher temperatures than previously known polycrystalline diamonds. Both types of polycrystalline diamonds are available in a wide variety of shapes and sizes. Polycrystalline diamond composite compacts are commercially available to the drilling industry from General Electric Co. under the "STRATAPAX" trademark. A comprehensive description of STRATAPAX diamond cutting elements and prior art bits utilizing the elements is found at pages 541–591 of a book entitled ADVANCED DRILLING TECHNIQUES by William C. Maurer, published by The Petroleum Publishing Company, 421 S. Sheridan, P.O. Box 1260, Tulsa, Oklahoma 74101.

PDC drill bits have been manufactured utilizing a wide variety of techniques and structures for mounting the cutters over the face of the bit and an equally wide variety of patterns or position arrangements of the cutters. In some prior art bits the cutters are individually mounted in various patterns. In other forms of prior art bits the cutters are mounted in group or clusters arranged in a wide variety of patterns. U.S. Pat. No. 4,073,354, to Rowley et al, issued Feb. 14, 1978, shows individual polycrystalline diamond cutters arranged over the face of a bit extending from the bit center to the bit gage in longitudinal arrays. Additionally, the center of the bit includes small individual diamonds set between the cutters to supplement the cutting effect of the cutters at the bit center. Other similar arrangements of the use of individual separate cutters are shown in U.S. Pat. Nos. 4,700,790, issued Oct. 20, 1987 to Shirley, 4,733,735 issued Mar. 29, 1988 to Barr et al, 4,596,296, issued June 24, 1986 to Matthias, 4,323,130, issued Apr. 6, 1982 to Dennis, UK patent application GB 2,085,945 of Jurgens published May 6, 1982 and in U.S. Pat. No. 4,350,215 issued Sept. 21, 1982 to Radtke, the latter patent showing cutters arranged in a longitudinally extending spiral pattern from the face of the bit to the bit gage. U.S. Pat. No. 4,696,354 issued Sept. 29, 1987 to King et al, shows individual cutters arranged in longitudinal radial array from the center face of the bit to planar pads along the bit gage portion. Small diamonds are embedded in the planar pad surfaces interrupted by longitudinal troughs. A similar bit using diamond cutters mounted individually in longitudinal radial alignment along the bit face is shown in U.S. Pat. No. 4,733,734 issued Mar. 29, 1988 to Bardin et al.

Further bit designs using diamond cutters arranged in clusters or groups are shown in U.S. Pat. No. 4,667,756 issued May 26, 1987 to King et al and in U.S. Pat. No. 4,714,120, issued Dec. 22, 1987 to King. These patented bits use clusters of tightly grouped cutters which share a common backing. The numbers of cutters included in each cluster vary. In the bit of U.S. Pat. No. 4,714,120, individual cutters are mounted on the bit face as well as clusters each including as few as two cutters and others as many as four cutters. A still further form of bit using thermally stable polycrystalline diamond material is shown in U.S. Pat. No. 4,602,691 issued July 29, 1986 to Weaver. The Weaver bit uses a variety of shapes of cutting elements grouped in like kinds extending in longitudinal radial rows from the bit center to the bit gage which is set with small diamond particles. Along the junction between the bit face and the gage of the Weaver bit, some rows include cylindrical shaped diamond inserts. So far as is presently known, those prior art bits previously described, as well as other known available bits, using cylindrical cutters and cutters having faces in the shapes of segments of circles utilize cutters of substantially the same area which generally range from 0.50 inches to 0.58 inches in diameter. Recently, cutters ranging from 0.70 to 0.79 inches in diameter and 0.90 to 1.0 inches in diameter and even larger have been available to the bit industry. The bit designs using these larger diameter cutters have set the entire bit with cutters of the same diameter, or, alternatively, have reduced the cutter diameter only at the very gage of the bit. In some instances smaller diameter cutters in the 0.50 inch range have been used at the centers of bits and then intermixed across the bit face with larger diameter cutters. In still other bits, cutters arranged over most of the bit face have been 0.50 inches in diameter with larger cutters set only on the bit shoulder. In drilling bore holes with the available prior art PDC bits, particularly in fast drilling applications which include transitional layers of shale and sand, those bits employing larger cutters tend to fail on the bit shoulder. Bits utilizing small cutters tend to slow down in the shale. Additionally, where the cutters are individually mounted, the cutters are more likely to fail by shearing from the bit matrix.

SUMMARY OF THE INVENTION

It is a principal object of the invention to provide a new and improved drag type rotary drill bit.

It is another object of the invention to provide a new and improved drill bit of the character described which minimizes cutter failure.

It is another object of the invention to provide a drill bit of the character described which drills shale portions of earth formations without bit speed reduction.

It is another object of the invention to provide a drill bit of the character described which provides maximum drilling rate in earth formations with minimum cutting element damage.

It is another object of the invention to provide a drag type rotary drill bit which includes mixed sizes of cutters providing an improved production rate while maintaining bit durability In accordance with the invention, there is provided a drag type rotary drill bit utilizing cutting elements having a variety of cutting face areas ranging from a maximum area over the center of the bit face to a minimum area extending to the bit gage. Further, in accordance with the invention, a drag type rotary drill bit is provided utilizing the largest cutting elements at the center of the bit face, intermediate size cutting elements outwardly to or just past the nose of the bit profile, and the smallest cutting elements from the nose over the bit shoulder to the full bit gage diameter. Still further, in accordance with the invention, a drag type rotary drill bit of the PDC type is provided utilizing cutters of maximum diameter over the center of the bit face, cutters of intermediate diameter from the largest cutters outwardly to or just past the nose of the bit profile, and the smallest cutters over the bit face from the bit nose over the shoulder to the full gage diameter of the bit. The cutters are mounted individually or in clusters sharing a common backing, with the clusters varying in the number of cutters included in each cluster. The clusters may be arranged in longitudinal radial lines or randomly set from the bit center to the bit gage. At the bit gage the smallest cutters join thermally stable polycrystalline diamond cylinders set at the transition of the bit face to the gage portion of the bit, while small particles of diamonds are set flush in the bit matrix along the gage portion.

Additional objects, features, and advantages of the invention will be apparent from the following written description taken in conjunction with the accompanying drawings.

DESCRIPTION OF A PREFERRED EMBODIMENT OF THE INVENTION

Figure 1:
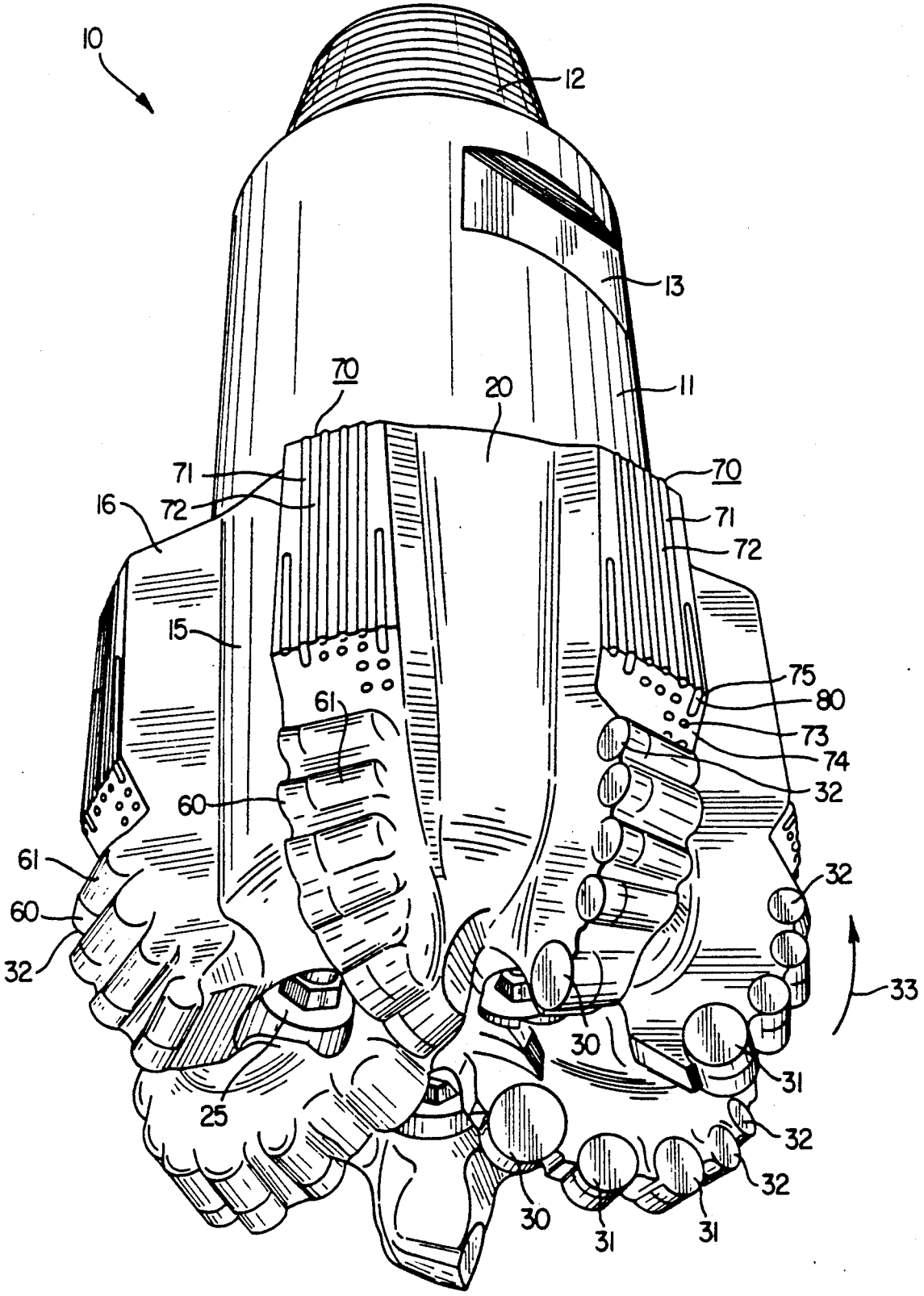
FIG. 1 is a perspective view of a preferred form of the drill bit of the invention as seen from below and to one side of the bit with the bit in a normal drilling position.

Referring to the drawings, a drill bit 10 embodying the features of the invention has a body 11 provided with a threaded shank 12 for connection of the drill bit on the lower end of a drill string, not shown, which rotates the bit for drilling a borehole in an earth formation. A pair of oppositely positioned wrench flats 13 are formed on the body spaced from the threaded shank for fitting a wrench to the bit to apply torque when connecting and disconnecting the bit on the drill string. The bit body has a central longitudinal bore 14, FIG. 4, opening through the threaded shank for flow of drilling fluid from the drill string into the bit.

Figure 4:
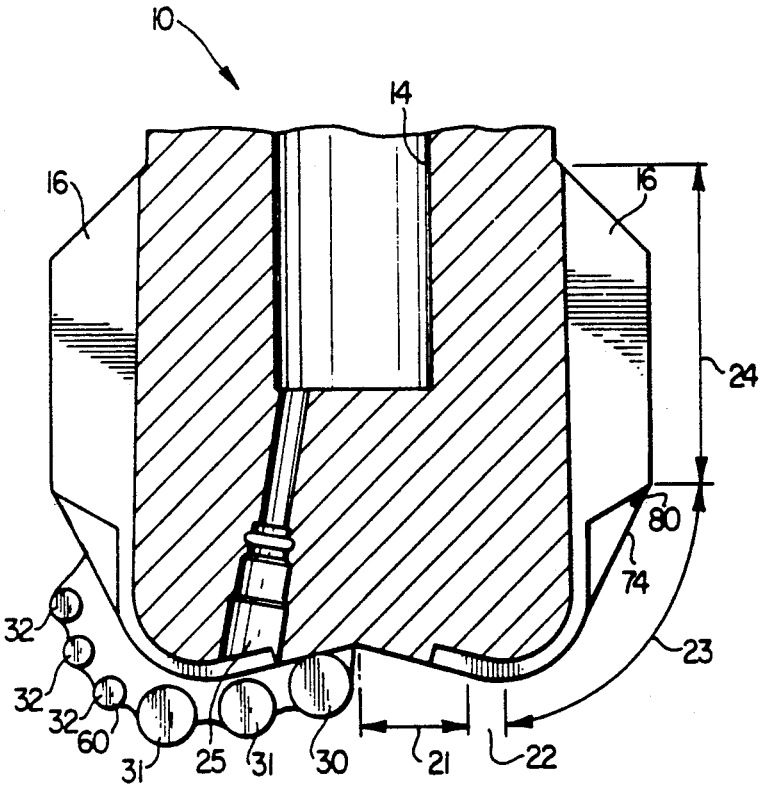
FIG. 4 is a fragmentary schematic view in section showing on the left side the bit along a line 4—4 in FIG. 2 including a drilling fluid circulation nozzle and showing on the right side the bit head with the cutters removed.

Along the opposite drilling end portion of the drill bit 10 from the shank end is a head or matrix 15 formed as seen in FIGS. 1 and 4 to include longitudinal circumferentially spaced lands 16 separated by longitudinal grooves 20 defining drilling fluid flow courses between and along the faces of cutters mounted on the bit matrix. For purposes of reference and to aid in the description of the cutter configuration of the bit, the bit face is separated into several areas or zones identified along the right hand portion of FIG. 4. Referring to FIG. 4, the center of the bit face is identified by the reference numeral 21, the nose, the approximate low point on the lower end of the bit, by the reference numeral 22, the shoulder, the upturning curved portion of the bit leading to the gage portion by the reference numeral 23, and the maximum diameter gage portion along the side of the bit by the reference numeral 24. It is to be understood, however, that such areas and points of reference on the bit face are approximate and only for purposes of describing the cutter distribution over the bit face.

Figure 2:
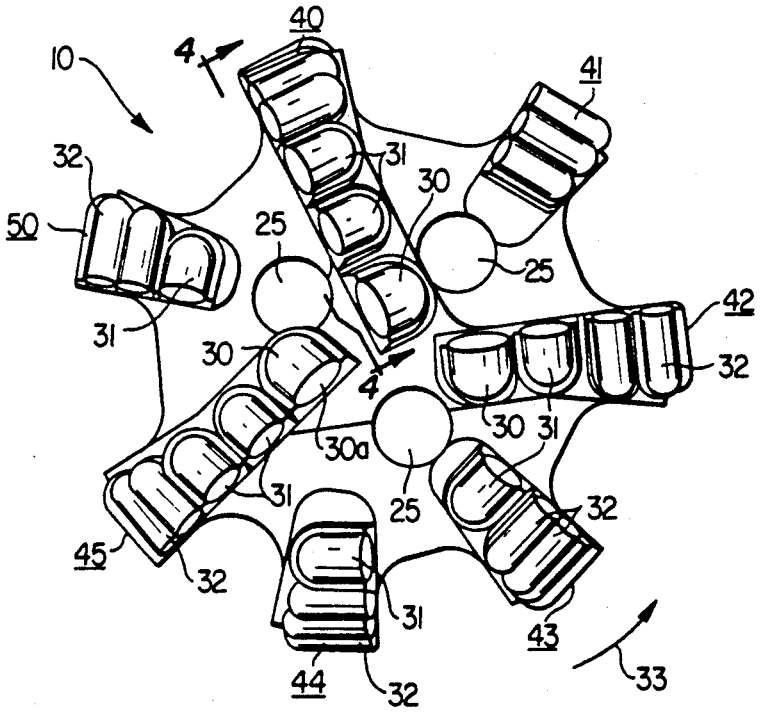
FIG. 2 is a lower end view of the bit of FIG. 1.

Referring to FIGS. 2 and 4, the bit head 15 is provided with downwardly and outwardly extending flow passages or nozzles 25 which open at lower ends through the center of the bit face and communicate at upper ends with the central bit bore 14 for distribution of drilling fluid into a borehole around the cutters for flushing cuttings and related functions previously described. The number, shape, positions, and size of the drilling fluid flow passages 25 may vary depending upon the particular bit design and drilling conditions under which the bit is to be operated.

State of the art materials and techniques are used to form the drill bit shank and head. Drill bits of the character of the invention are generally classified as either steel bodied bits or matrix bits. The steel bodied bits are machined from a steel block and typically having cutting elements press-fitted int recesses provided in the bit face. Matrix type drill bits are manufactured by casting the matrix material in a mold over a steel mandrel. The mold is fabricated from graphite stock by turning on a lathe and machining a negative of the desired bit profile. Cutter pockets are milled in the interior of the mold and dressed to define the position and angle of the cutters. The bore 14 and the drilling fluid flow passages 25 are formed by positioning temporary displacement material within the interior of the mold. A steel mandrel is inserted into the interior of the mold and tungsten carbide powders, binders, and flux are added to the mold. The bit matrix may comprise a suitable material such as disclosed in U.S. Pat. No. 3,175,629 issued Mar. 30, 1965 to David S. Rowley. Such matrix material is classified as copper-nickel alloy containing powdered tungsten carbide. The steel mandrel acts as a ductile core to which the matrix material adheres during the casting and cooling steps. The bit is then fired in a furnace, the mold is removed, and the cutters are mounted in the matrix over the bit face using patterns embodying the features of the invention and known installation techniques and structures.

Cutting elements or cutters 30, 31, and 32 are mounted in the bit matrix comprising the center, nose area, and shoulder of the bit face as identified in FIG. 4. In the particular configuration of the bit 10 illustrated in FIGS. 1 and 2, the cutters are arranged in rows along the lands 15 extending along the lands on the bit center 21, past the nose 22, and over the shoulder 23 to the juncture of the shoulder area with the bit gage portion 24. The drill bit 10, as illustrated, is designed to rotate counterclockwise as indicated by the arrow 33 viewed from the lower end of the bit. The cutter faces, such as the face 30*a*, are oriented in the direction of rotation of the bit so that each cutter face bites into the drilled earth formation as the bit is rotated and forced downwardly through the formation. The torque required to turn the bit is a function of a number of factors, including, particularly, the areas of the cutting faces of the cutters 30, 31, and 32. In accordance with the invention, a new and novel cutter face area combination and cutter location configuration is embodied in the drill bit 10. Cutters 30 of maximum size cutting faces are arranged over the center area 21 of the bit face. Those cutters 31 having cutting faces of intermediate area are distributed over the bit face from center to or just past the nose 22 of the bit face. Those cutters 32 having the smallest cutting face areas are arranged from approximately the nose 22 over the shoulder area 23 of the bit face extending to the full gage diameter as identified by the reference numeral 24 in FIG. 4. A typical example of a specific embodiment of a drill bit is illustrated in the bit 10 of the drawings. Varying numbers of the maximum size cutters 30, the intermediate size cutters 31, and the smallest size cutters 32, are arranged in radial longitudinally extending lines along the lands 15. Referring to FIG. 2, a specific arrangement and numbers of cutters over the bit face beginning at the top of FIG. 2 are: row 40, 1 cutter 30, 2 cutters 31, 5 cutters 32; row 41, 4 cutters 32; row 42, 1 cutter 30, 1 cutter 31, 4 cutters 32; row 43, 1 cutter 31, 4 cutters 32; row 44, 1 cutter 31, 3 cutters 32; row 45, 1 cutter 30, 2 cutters 31, 4 cutters 32; and row 50, 1 cutter 31, 3 cutters 32. A total of 38 cutters are mounted over the bit face. A bit embodying the invention as shown in FIGS. 1 and 2 was 8.75 inches in diameter using three different cutter face area sizes. On bits of 10 inches diameter and larger, four different cutter face area sizes are preferred.

The cutters 30, 31, and 32 may be formed of a variety of super hard materials such as polycrystalline diamond composite compacts, PDC's, heretofore described as commercially available from General Electric Co. under the trademark STRATAPAX, thermally stable polycrystalline discs, and cubic boron nitride, which has become recently available from diamond material vendors. The particular cutters represented in the bit 10, as shown in FIG. 1, may be the STRATAPAX cutters which are formed by sintering a polycrystalline diamond layer 60 to a tungsten carbide substrate 61. In the particular form of the cutters illustrated, the cutting faces are circular, and thus, the cutters 30 are of maximum diameter, the cutters 31 of intermediate diameter, and the cutters 32 of minimum diameter. The cutters, as illustrated, are cylindrical. As seen in FIG. 1 and in U.S. Pat. No. 4,714,120, the material forming the matrix of the bit joins the cutters together in groups and forms a backing of the cutter rows along the sides of the rows opposite the cutter faces.

Figure 3:
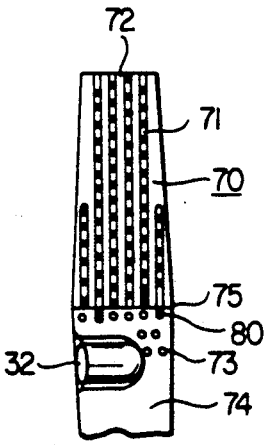
FIG. 3 is a fragmentary side view in elevation illustrating one of the cutters on the bit at a gage section and one of the planer pads along the gage section.

The gage portions 24 along the lands 15 of the bit matrix form planar pads 70 comprising longitudinal rows 71 of small diamonds, which may be natural or thermally stable polycrystalline, embedded along the matrix surface separated by longitudinal troughs 72 formed in the matrix surface. Scattered groupings of similar diamond clusters 73, FIGS. 3 and 4, are arranged along the tapered portion 74 of the lands at the juncture of the planar pads 70 with the rows of the cutters. Along the junction line 75 between the planar pads 70 and the tapered portion 74 of each of the lands, certain of the rows 71 also include cylindrical inserts 80 which may be thermally stable polycrystalline diamonds such as sold by General Electric Co., under the "GeoSet" trademark. The cylindrical inserts 80 provide gage point protection along the lower end edges of the planar pads 70 which cut the gage or maximum diameter portion of a borehole as the drill bit drills the hole.

Field tests of drag type rotary drill bits embodying the features of the invention have demonstrated significant improvements in performance over prior art PDC type drill bits, utilizing uniform diameter cutters. The maximum diameter cutters at the center of the bit travel at a lower lineal rate of speed than the minimum diameter cutters around the periphery of the bit. There is, thus, a balancing of the work load which tends to extend bit life. By deploying the largest cutters in the circumferentially slow moving center of the bit, wide cuts can be made by each cutter and the larger cutter face exposure allows for free cleaning. Farther out from the bit center, the circumferental distance covered by each cutter increases. The drilled formation responds to a greater number of narrower cutting tracks. The smaller diameter cutters on the abrasive sensitive shoulder of a bit provide for even narrower, less heat generating cutting tracks to combat abrasive wear. In order for the shale sections to be drilled effectively, it is preferred to deploy the novel cutting structure in a bladed or ribbed fashion as illustrated.

While a preferred embodiment of the drill bit of the invention is the arrangement illustrated in FIGS. 1 and 2 of groups of PDC compact cutting elements over the face of the bit with the size of the cutting faces varying from a maximum at the bit center to a minimum along the gage portion of the bit, it is to be understood that within the scope of the invention a variety of cutting elements, mounting structures and systems, and configurations of cutting element positions may be used within the scope of the invention. Individually mounted cutting elements may be positioned in radial longitudinal lines and random patterns as shown in U.S. Pat. Nos. 4,221,270, 4,696,354, 4,244,432, 4,574,895, 4,505,342, 4,246,977, and 4,073,354, incorporated herein by reference. Another pattern of cutting element arrangement which may be used, in accordance with the invention, is the random positioning of cutting elements from single elements to groups of elements sharing a common matrix backing and varying in numbers from two to four or more cutting elements, as illustrated in U.S. Pat. No. 4,714,120 also incorporated by reference. The numbers of different sizes of cutting faces on the cutting elements may vary depending upon the size of the bit cutting face, with the sizes being progressively graduated from a maximum at the center of the bit face to a minimum at the bit gage. In each of the various patterns used, in accordance with the invention, small diamond cutting elements are arranged along the bit gage in either random fashion or in longitudinal lines, as shown in U.S.

Pat. Nos. 4,350,215, 4,733,734, 4,714,120, 4,696,354, and others referred to herein.

The averaging of the work load over the various cutting elements has improved the drilling efficiency of bits made in accordance with the invention as well as the durability of the bits in reducing bit failure. The invention resides in the arrangement of cutters of maximum cutting face area over the bit center to cutters of minimum cutting face area along the bit shoulder to the gage portion of the bit. The numerous forms of cutters and cutter materials and cutter patterns of arrangement known in the prior art may be used within the scope of the invention.

What is claimed is:

1. An earth boring bit comprising:

a body having a shank on one end with a tubular bore and means for connection to a drill string for rotation about a longitudinal axis;

a matrix formed on the opposite end of said body providing a face of said bit extending from a center end face portion to a gage portion;

said body having at least one drilling fluid flow passage opening through said face of said bit communicating said face with said tubular bore for circulating drilling fluids from said drill string outwardly around said bit during drilling; and a plurality of cutting elements mounted on said face of said bit distributed over said face from said center of said face to said bit gage, said cutting elements having cutting faces oriented in the direction of rotation of said bit during cutting, and said cutting faces varying in area from a maximum over said center of said bit to a minimum at said bit gage.

2. An earth boring bit in accordance with claim 1 wherein said cutting elements are individually mounted over said face in a random pattern.

3. An earth boring bit in accordance with claim 1 wherein a portion of said cutting elements are individually mounted on said bit face and the remainder of said cutting elements are mounted in clusters sharing common backings along said matrix, of each said clusters including at least two of said cutting elements and said clusters are arranged in a random pattern over said face.

4. An earth boring bit in accordance with claim 1 wherein said cutting elements are individually mounted over said matrix along longitudinal radial lines.

5. An earth boring bit in accordance with claim 1 including a plurality of longitudinal circumferentially spaced planar pads formed on said matrix extending along said gage portion from said face toward said shank;

a plurality of cutting elements embedded in said matrix along said planar pads; and gage point protection members embedded in said matrix along said bit face at said planar pads.

6. An earth boring bit comprising:

a body having a shank along one end with a tubular bore and means for connection to a drill string for rotation of said bit about a longitudinal axis;

a head formed along the opposite end portion of said body provided with a matrix material forming a bit face including a center end bit face portion, a nose portion, a shoulder portion, and a gage portion extending along a maximum diameter of said bit head toward said shank;

flow passage means in said head connecting with said tubular bore to flow drilling fluid from said drill string over said bit face;

a plurality of polycrystalline diamond compact cutters mounted over said face portions of said bit head in said matrix material, each of said cutters having a substantially cylindrical cutting face oriented toward the direction of rotation of said bit during cutting, said cutters comprising a plurality of separate groups of cutters, said cutters in each group being of the same diameter cutting faces, said cutters having maximum diameter cutting faces being arranged over said center end portion of said bit face, said cutters being arranged in said groups in decreasing diameter sequence along said bit face portions with cutters of minimum diameter cutting faces being arranged along said shoulder portion of said bit face extending to said gage portion;

drilling fluid flow courses defined in said matrix over said face between said cutters;

longitudinal circumferentially spaced planar pads formed along said gage portion of said bit face, ends of said planar pads toward said bit face center joining the minimum diameter cutters; and a plurality of diamonds embedded along the surface of said planar pads of said gage portion of said bit.

7. An earth boring bit comprising:

a body having a shank along one end with a tubular bore and means for connection to a drill string for rotation of said bit about a longitudinal axis;

a head formed along the opposite end portion of said body provided with a matrix material forming a bit face including a center end bit face portion, a nose portion, a shoulder portion, and a gage portion extending along a maximum diameter of said bit head toward said shank;

flow passage means in said head connecting with said tubular bore to flow drilling fluid from said drill string over said bit face;

a plurality of polycrystalline diamond compact cutters mounted over said face portions of said bit head in said matrix material, each of said cutters having a substantially cylindrical cutting face oriented toward the direction of rotation of said bit during cutting, said cutting faces of said cutters varying in size, said cutters having maximum diameter cutting faces being arranged over said center end portion of said bit face, said cutters being arranged in decreasing face diameter sequence along said bit face portions with cutters of minimum diameter cutting faces being arranged along said shoulder portion of said bit face extending to said gauge portion;

drilling fluid flow courses defined in said matrix over said face between said cutters;

longitudinal circumferentially spaced planar pads formed along said gage portion of said bit face, ends of said planar pads toward said bit face center joining the minimum diameter cutters; and a plurality of diamonds embedded along the surface of said planar pads of said gage portion of said bit.

8. An earth boring bit in accordance with claim 7 wherein said cutters while remaining in said decreasing diameter sequence are individually mounted in said matrix in a random pattern over said face portions.

9. An earth boring bit in accordance with claim 7 wherein a portion of said cutters are individually mounted on said face portions and the remainder of said cutters are mounted in groups having a minimum of two cutters per group sharing a common backing of said matrix material, said groups containing cutters which remain in said decreasing diameter sequence being arranged in a random pattern over said face portions.

10. An earth boring bit in accordance with claim 7 where said cutters are individually mounted in said matrix and arranged in a plurality of radial longitudinal rows.

11. An earth boring bit in accordance with claim 7 wherein a portion of said cutters are individually mounted and the remainder of said cutters are mounted in groups having a minimum of two cutters per group sharing a common backing and arranged in radial longitudinal rows circumferentially spaced around said bit face portions.

* * * * *